United States Patent [19]

Bertrand

[11] Patent Number: 4,641,584

[45] Date of Patent: Feb. 10, 1987

[54] ELECTRICALLY DRIVEN DETACHABLE GONDOLA LIFT OR CHAIR LIFT

[75] Inventor: Jean-Jacques Bertrand, Fontaine, France

[73] Assignee: Pomagalski, S.A., Fontaine, France

[21] Appl. No.: 782,302

[22] Filed: Oct. 1, 1985

[30] Foreign Application Priority Data

Oct. 15, 1984 [FR] France ..... 84 15865

[51] Int. Cl.[4] ..... B61B 11/00

[52] U.S. Cl. ..... 104/173.2; 104/178; 322/88

[58] Field of Search ..... 104/173 R, 173 ST, 178; 318/146, 148, 150, 158; 322/46, 88

[56] References Cited

U.S. PATENT DOCUMENTS 2,761,097 8/1956 Tourneau ..... 322/88 X
4,015,189 3/1977 Gorden ..... 322/46

FOREIGN PATENT DOCUMENTS 0125967 11/1984 European Pat. Off. .
2060030 6/1972 Fed. Rep. of Germany .
2094270 2/1972 France .
2416821 9/1979 France .
420242 3/1967 Switzerland .

*Primary Examiner*—Robert B. Reeves
*Assistant Examiner*—David F. Hubbuch
*Attorney, Agent, or Firm*—Parkhurst & Oliff

[57] ABSTRACT

A detachable chair or gondola lift is disclosed wherein an alternator is driven by a rope bull-wheel. The alternator supplies a synchronous motor for driving friction wheels or other mechanisms for driving the cars in an end station of the chair or gondola lift. The electrical connection between the alternator and the synchronous motor ensures synchronous rotation of the motor. The alternator can be connected to the bull-wheel by a multiplier gear, the bull-wheel being either a tension bull-wheel or a driving bull-wheel. In the case of a tension bull-wheel, the alternator is mounted on the bull-wheel support carriage to avoid a flexible mechanical transmission. The alternator can be coupled to the high speed shaft of a driving bull-wheel reducer gear, for example, by a trapizoidal belt transmission. At low speed, the excitation of the alternator is increased to preserve the synchronism of the movements. Such excitation is accomplished by an auxiliary power source, or by self excitation by suitable permanent magnets and filters.

6 Claims, 7 Drawing Figures

ELECTRICALLY DRIVEN DETACHABLE GONDOLA LIFT OR CHAIR LIFT

BACKGROUND OF THE INVENTION

The invention relates to an aerial ropeway installation, notably a detachable chair lift or gondola lift, having a rope extending in an endless loop between two stations, in which it passes on return bull-wheels, one of which is the drive wheel, the loads, notably the cars or chairs, being coupled to the rope on the line and detached in the stations to run on transfer rails fitted with means of driving at a speed proportional to that of the rope.

The invention is described hereinafter as being applied to a detachable chair lift, but it is obvious that it is applicable to other installations such as gondola lifts, single and double-cable transporters, etc.

In detachable chair lifts, it is important, or even indispensable to ensure and maintain continuously with no drift in time a synchronism between the movements on the line and in the stations, both for coupling without the grip slipping on the rope when leaving the station, and to maintain a regular flow rate throughout the whole operating period.

In state of the art installations, the friction wheels or chains hauling the chairs in the station are driven by means of a device bearing on the rope, for example a wheel fitted with a tire in contact with the rope.

This mechanical link gives satisfaction, but it lacks flexibility and is difficult to implement, notably on mobile and (or) relatively long structures.

The object of the present invention is to provide a simplified installation, wherein the synchronism of the movements is maintained perfectly over a wide range of speeds.

SUMMARY OF THE INVENTION

In the transport installation according to the invention, said driving means comprises a synchronous electric drive motor, supplied with alternating current by an electrical alternator, mechanically connected to the station bull-wheel by a desmodromic mechanical link ensuring that the alternator rotates at a multiple speed of that of the bull-wheel.

By coupling the alternator to the bull-wheel or to a part rigidly secured in rotation to this bull-wheel, the alternator is driven at a speed proportional to that of the rope and supplies a current whose frequency is proportional to this speed.

The synchronous motor supplied by this current runs at a perfectly proportional speed, except when a break-off due to too high a resisting torque occurs causing the motor and consequently the installation to stop.

The electrical connection between the alternator and the motor can be relatively long and be comprised of flexible cables, the same alternator being able to drive several motors, each fitted in the vicinity of the parts it drives.

This solution is based on the establishment of the fact that any slipping of the rope on the bull-wheel is excluded and it is notably more reliable than a state of the art electrical device, which uses a direct current motor whose speed is regulated by the signal from a tachometric generator driven by the rope. This regulation does in fact present a drift in time which is practically unacceptable.

The alternator can be connected to the bull-wheel by a multiplier gear, the bull-wheel being either a tension bull-wheel or a driving bull-wheel.

In the case of a tension bull-wheel, the alternator is mounted on the bull-wheel support carriage to avoid a flexible mechanical transmission.

The alternator can be coupled to the high speed shaft of the driving bull-wheel reducer gear, for example by a trapezoidal belt transmission, avoiding any slipping.

The operating speed range of the equipment varies from 1 to 10, if not more, and synchronism must be ensured for all these speeds. According to a development of the invention, the alternator is fitted with additional excitation means, triggered at speeds below a preset threshold. These means comprise, according to a first embodiment, an auxiliary power source, such as a battery, which supplies a current to an alternator excitation coil when the threshold is reached.

According to an alternative embodiment, the alternator self-excitation is increased at low speed for example by suitable filters and permanent magnets.

BRIEF DESCRIPTION OF THE DRAWINGS

Other advantages and characteristics of the invention will become more clearly apparent from the description which follows of an embodiment of the invention, given as an example only and represented in the accompanying drawings, in which.

BRIEF DESCRIPTION OF THE PREFERRED EMBODIMENTS

Figure 1:
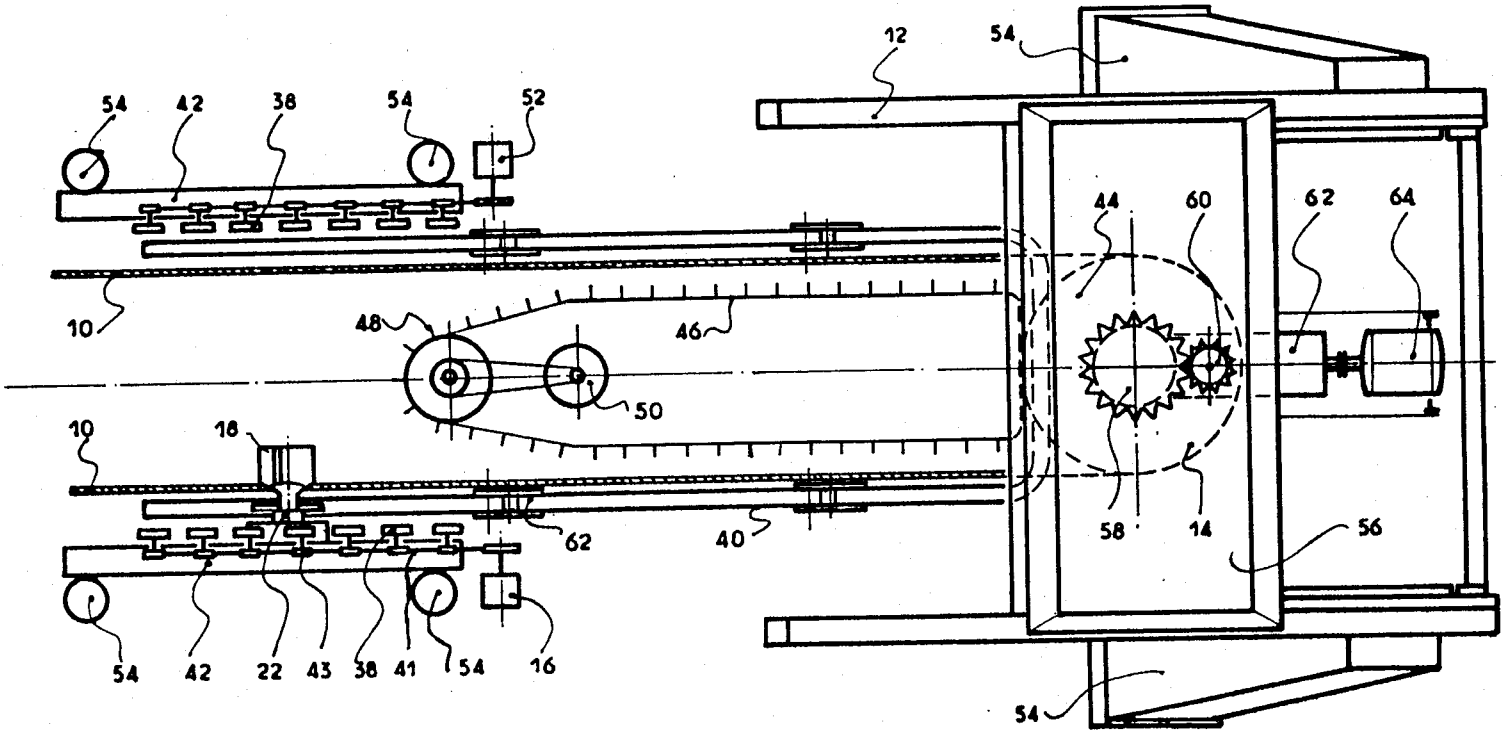
FIG. 1 is a schematic plan view of a chair lift station according to the invention.
Figure 2:
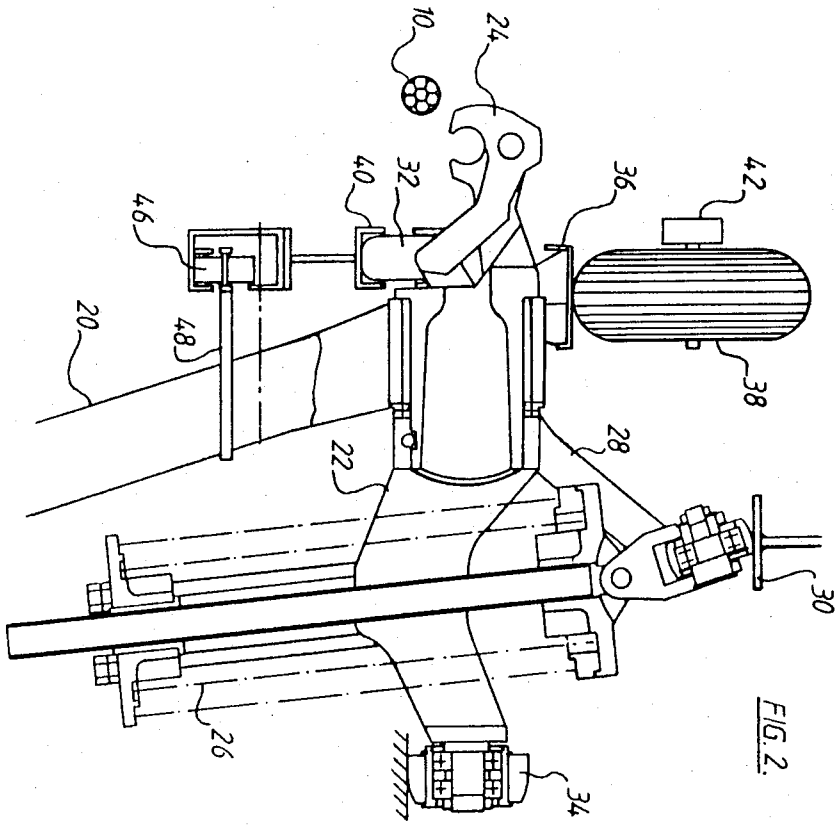
FIG. 2 is a side view of a chair support carriage.

In the figures, an aerial ropeway 10 of a single-cable chair lift, which could be a gondola lift or similar single or double-cable transporter, runs in a terminal station 12 on a bull-wheel 14.

The chairs 18 are fixed by a hanger arm 20 to a carriage 22 supporting a grip 24 for coupling to the rope 10. A spring 26 urges the grip 24 into the rope clamping position, opening being controlled by a lever 28 cooperating with a fixed ramp 30.

The carriage 22 bears roller sheaves 32 and positioning sheaves 34 and a drive plate 36 cooperating with drive wheels 38 fitted with tires.

A grip of this kind is for example described in U.S. Pat. No. 4,441,430, the disclosure of which is herein incorporated by reference.

At the entry to the station 12 a transfer rail 40 on which the sheaves 32 engage is fitted parallel to the rope 10. Simultaneously the lever 28 controlling opening of the grip 24 engages the ramp 30 to open the grip 24 and detach the carriage 22 from the rope 10. A slight relative movement of the carriage 22 in relation to the rope 10 detaches the latter from the grip 24. A set of tired wheels 38, supported by a girder 42 parallel to the rail 40, cooperate with the plate 36 of the carriage 22 to drive the latter. The wheels 38 are connected to a motor 16 by a universal joint 41 and reducer 43 transmission or by belt transmissions, the first wheels of the set turning at the speed of the rope 10 to synchronize the movement of the carriage 22, whereas the following wheels 38 decelerate the carriage 22 detached from the rope 10 and running on the rail 40. The rail 40 extends in a half-loop in the station and joins up with the other strand of the rope 10 which makes up the other track of the chair lift passing in front of a loading area 44 if the station 12 is a loading station. It is clear that this station can be an unloading station or have both an unloading platform and a loading platform for passengers, particularly skiers.

On leaving the set of drive wheels 38, the carriage 22 is taken up by a chain 46 with driving or retaining pins 48 extending in a closed loop along the transfer rail 40 to drive the carriages 22 positively at reduced speed. Any other system of driving the carriages may of course be used. The chain is driven by a motor 50 which could be the motor 16 driving the wheels 38.

The station exit is similarly equipped with a set of wheels 38 driven by a motor 52, which accelerate the carriage 22 and synchronize its speed with that of the rope 10 before recoupling by the grip 24 closing on the rope 10. Chair lifts of this kind, with chairs which can be detached in the stations, are well known and enable loading and unloading to take place at reduced speed, the rope 10 continually running at high speed.

The bull-wheel 14 is supported by a carriage 56 mounted sliding on the framework 54 of the station to ensure the tension of the rope 10.

A cogwheel 58 is rigidly fixed to the bull-wheel 14 to drive, by means of a pinion 60 and a multiplier 62, for example a toothed gear device, an alternator 64 fixed to the carriage 56.

The alternator 64 runs at a speed proportional to that of the rope 10 and supplies a current of a frequency proportional to this speed.

Figure 4:
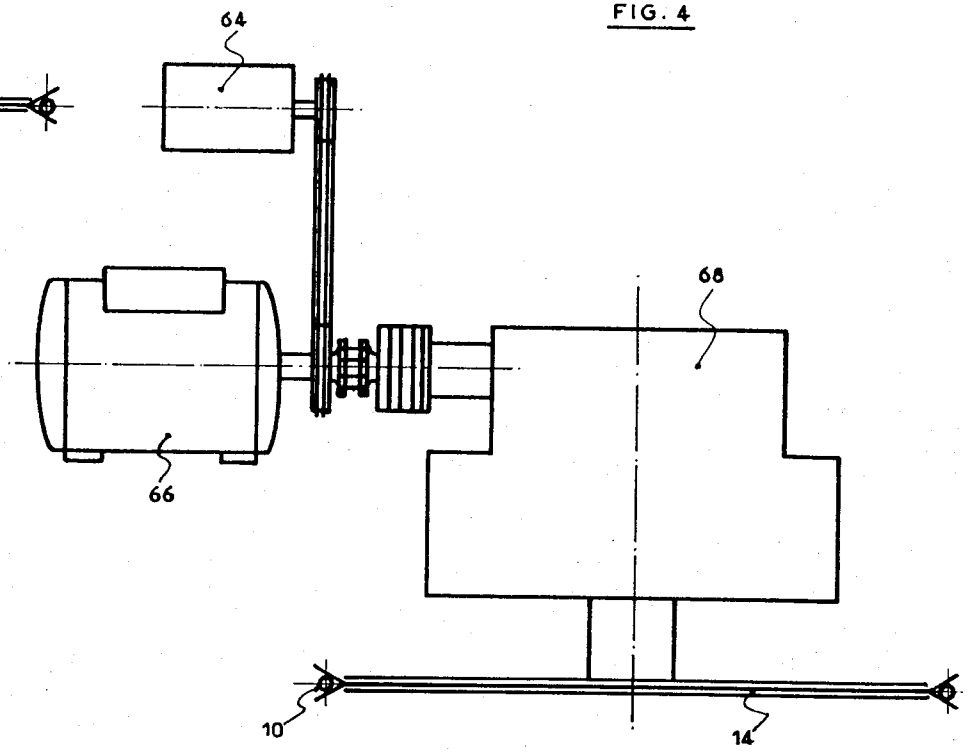
FIG. 4 is a similar view to that of FIG. 3 illustrating an alternative embodiment.
Figure 3:
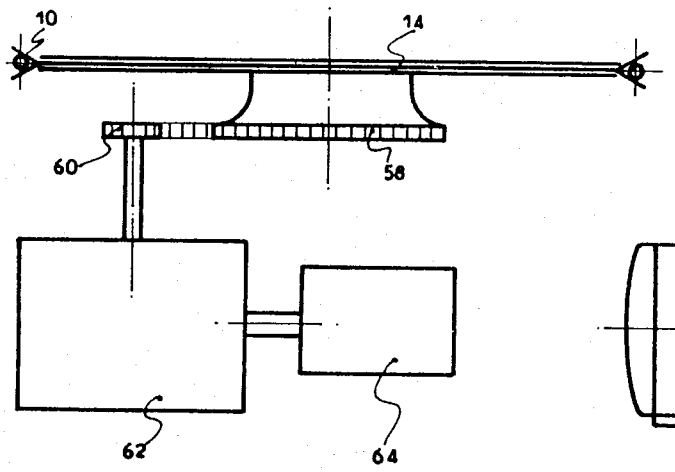
FIG. 3 is a detailed view illustrating the alternator drive mechanism.

FIG. 4 shows an alternative embodiment wherein the bull-wheel 14 is a drive wheel, driven in rotation by a motor 66 via a reducer 68. The alternator 64 is connected to the high speed shaft of the reducer 68 by a trapezoidal belt transmission which provides a rotation of the alternator at a multiple speed of that of the bull-wheel 14.

The current supplied by the alternator 64 is not modified by the method of driving the alternator, which could moreover be quite different.

Figure 5:
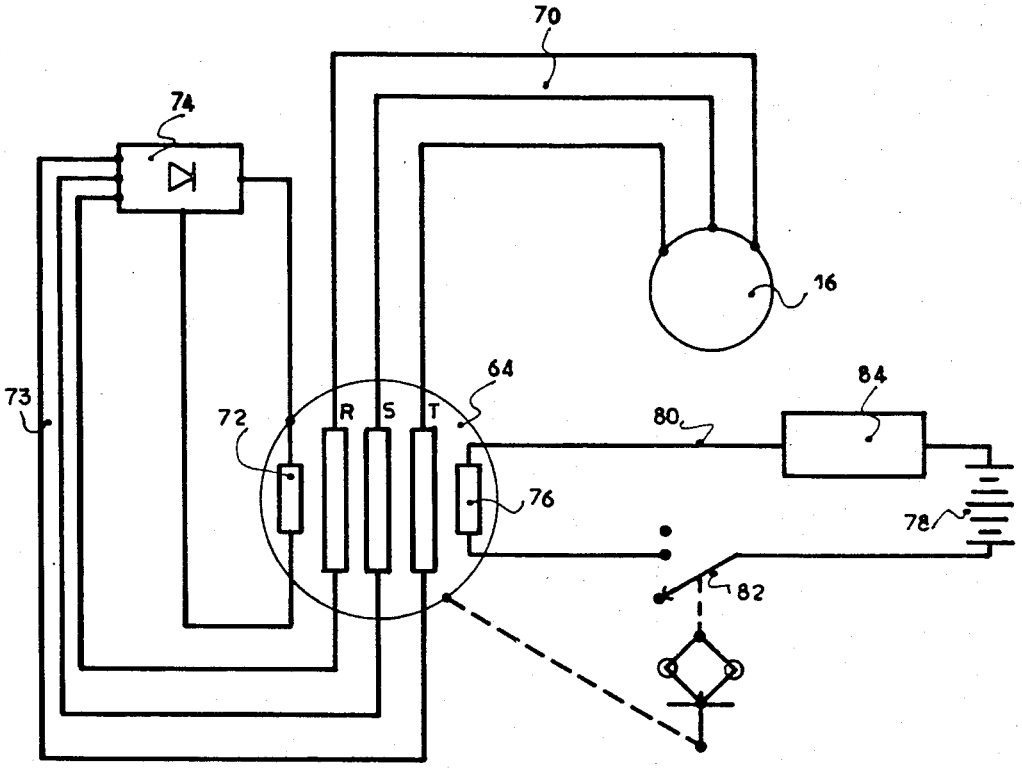
FIG. 5 shows the electrical diagram of a preferred embodiment.

The alternator 64 is connected to the motors 16, 50, 52 by three-phase cables 70, only the one which supplies the motor 16 being represented in FIG. 5.

The three phase windings R S T of the alternator 64, connected to the cable 70, also supply the excitation current to a coil 72 energizing the alternator 64 via a circuit 73, including a rectifier unit 74.

The alternator 64 has a second excitation coil 76 connected to a battery 78 by a circuit 80, in which a centrifugal control switch 82 and a regulating unit 84 are inserted.

The switch 82 is controlled by the alternator 64 to close automatically when the speed of the alternator drops below a preset threshold speed which is different from zero.

The power supply to the second excitation coil 76 enables the excitation at low speed to be increased and the characteristics of the alternator to be preserved for a synchronous power supply to the motor 16. In this way any break-off during low speed operating periods is avoided.

It is clear that the centrifugal switch 82 can be controlled in a different way, for example in terms of the characteristics or frequency of the current.

Figure 6:
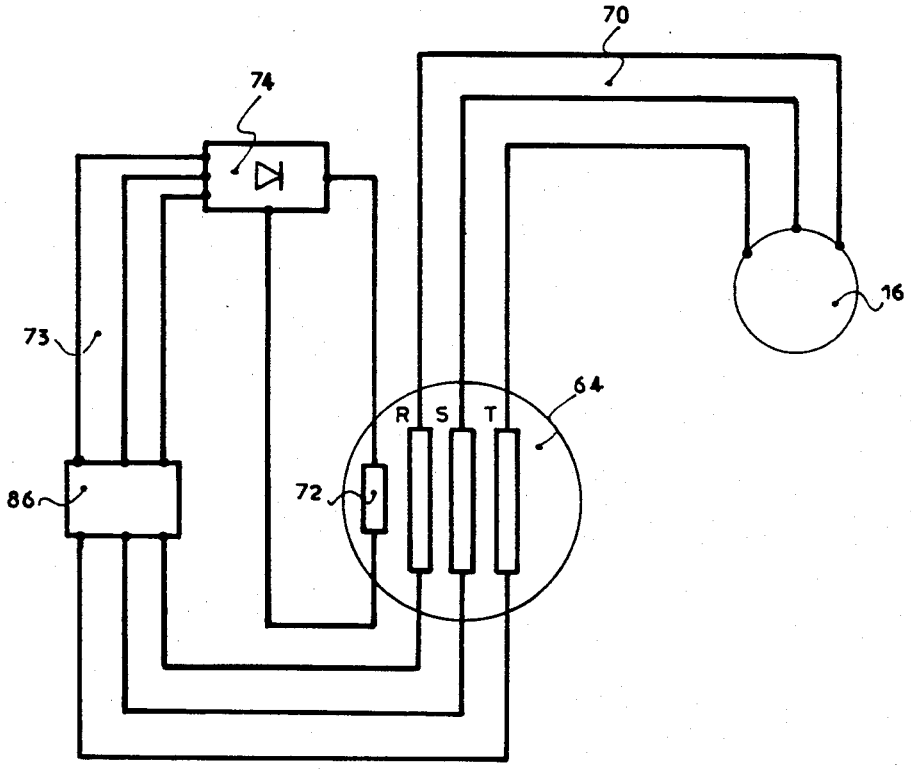
FIGS. 6 and 7 show the electrical diagrams of alternative embodiments.

In FIG. 6, which illustrates an alternative electrical diagram, the alternator 64 comprises a single excitation coil 72, supplied by the rectifier unit 74 in the way described hereabove.

A regulator 86 is inserted in the self-excitation circuit 73 and makes the excitation current vary in terms of the frequency of the current.

The regulator 86 can be a filter whose conductance is greater for low frequency currents. The excitation of the alternator varies automatically with its speed to preserve synchronism over a wide range of speeds.

The filter 86 can be replaced by a rheostat controlled by a speed sensor or any other equivalent means.

These means of adjusting the excitation do not require an auxiliary power source and can be advantageously built into the motor.

Figure 7:
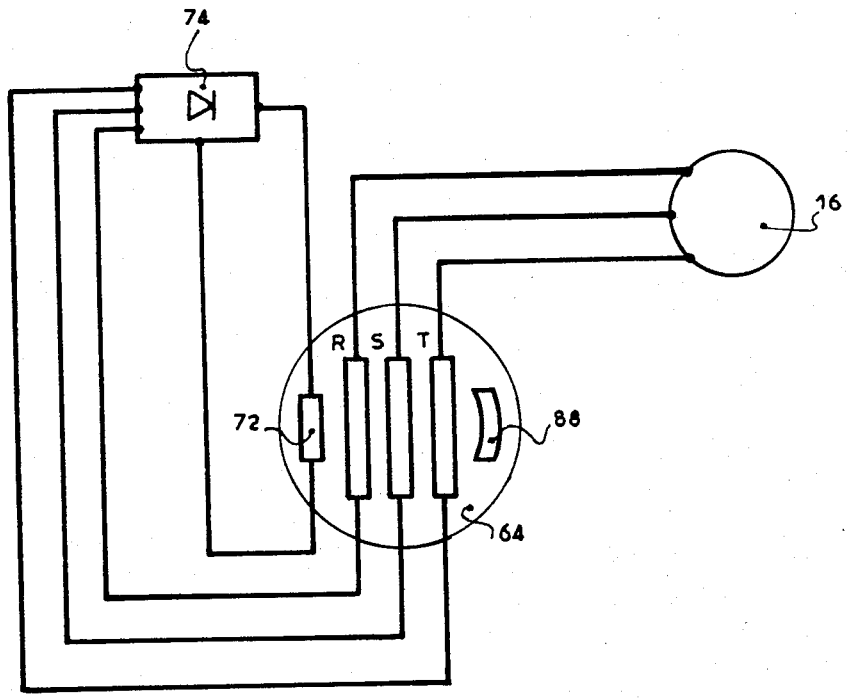

FIG. 7 illustrates a preferred embodiment wherein the alternator 64, in addition to the excitation coil 72, comprises a permanent excitation magnet 88, whose magnetic intensity is sufficient for the alternator to supply sufficient current, even at low speed, to drive the motor.

It is clear that the alternator 64 can supply a single motor, mechanically coupled to the set of friction wheels 38 or other driving means 46 and that the mechanical transmissions may be of any kind, for example trapezoidal belt.

The return bull-wheel can also drive several alternators, each supplying a synchronous motor.

The electrical cable connection between the alternator and the motor allows relative movement, notably of the tension carriage.

The electrical battery can be recharged by the alternator 64 during operating periods at normal or high speed, thus making the assembly autonomous.

What is claimed is:

1. Aerial ropeway transport installation, notably a detachable chair lift or gondola lift, comprising:

two end stations, end bull-wheels, on which a rope runs extending in an endless loop between the two stations, a bull-wheel motor for driving said bull-wheels in rotation, cars or chairs, which can be coupled to the rope in the loop and detached from the rope in the stations, transfer rails located in the stations, on which the cars or chairs run detached from the rope, driving means for driving the cars or chairs running on said transfer rails, a synchronous electric motor to drive said driving means, an electrical alternator and a kinematic chain connecting the alternator to the station bull-wheel to ensure that the alternator rotates at a multiple speed of that of said station bull-wheel, and an electrical connection between said alternator and said synchronous electric motor to supply the latter with the alternating current produced by the alternator and to ensure synchronous rotation of the motor.

2. Installation according to claim 1, wherein a speed reducer has a high speed shaft coupled to said bull-wheel drive motor and a low speed shaft coupled to said bull-wheel, said alternator being coupled to said high speed shaft.

3. Installation according to claim 1, wherein said alternator comprises an additional active excitation means at low rotation speed.

4. Installation according to claim 3, wherein said excitation means comprises an electrical battery, an alternator excitation coil connected to said battery by a power conductor comprising a switch designed to close automatically when the alternator rotation speed is lower than a preset threshold.

5. Installation according to claim 1, having a self-excitation alternator and a means of adjusting the self-excitation current designed to increase this current when the alternator rotation speed is lower than a preset threshold.

6. Installation according to claim 1, wherein said alternator comprises an excitation coil and an additional permanent excitation magnet.

* * * * *